US009056452B2

(12) United States Patent
Liu

(10) Patent No.: US 9,056,452 B2
(45) Date of Patent: Jun. 16, 2015

(54) SYSTEMS AND METHODS FOR INK-BASED DIGITAL PRINTING USING VARIABLE DATA LITHOGRAPHY INKJET IMAGING SYSTEM

(71) Applicant: Xerox Corporation, Norwalk, CT (US)

(72) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 118 days.

(21) Appl. No.: 13/900,201

(22) Filed: May 22, 2013

(65) Prior Publication Data

US 2014/0347422 A1 Nov. 27, 2014

(51) Int. Cl.
*B41J 2/01* (2006.01)
*B41J 2/005* (2006.01)

(52) U.S. Cl.
CPC ..... *B41J 2/0057* (2013.01)

(58) Field of Classification Search
CPC .... B41J 2/0057; B41C 1/1041; B41C 1/1008; B41F 7/04; B41F 7/24; B41F 7/26; B41N 1/003; B41N 3/08
USPC ..... 347/101–107; 101/147, 453, 463.1, 101/450.1, 375–377, 379; 399/401–401.1
See application file for complete search history.

(56) References Cited

U.S. PATENT DOCUMENTS

| | | | | |
|---|---|---|---|---|
| 5,378,580 | A * | 1/1995 | Leenders | 430/303 |
| 6,536,876 | B1 * | 3/2003 | Fotland et al. | 347/55 |
| 7,191,705 | B2 * | 3/2007 | Berg et al. | 101/465 |
| 8,136,936 | B2 * | 3/2012 | Hook et al. | 347/103 |
| 2012/0103212 | A1 | 5/2012 | Stowe et al. | |
| 2013/0104756 | A1 | 5/2013 | Stowe et al. | |

OTHER PUBLICATIONS

Liu et al., U.S. Appl. No. 13/426,262, filed Mar. 21, 2012.
Dalal et al., U.S. Appl. No. 13/529,581, filed Jun. 21, 2012.

* cited by examiner

*Primary Examiner* — Juanita D Jackson
(74) *Attorney, Agent, or Firm* — Ronald E. Prass, Jr.; Prass LLP

(57) ABSTRACT

A system for ink-base digital printing includes an imaging member; an inkjet system for applying a base marking material to the imaging member to for a pattern according to digital image data; a dampening fluid metering system configured for applying dampening fluid to the imaging member after the applying base marking material; and an inking system configured for applying ink to the imaging member, the ink adhering to the base marking material pattern. Methods include jetting base marking material onto the imaging member according to image data, applying dampening fluid, inking the imaging member, and optionally pre-curing the resulting ink image, which enables 99% or greater transfer of the applied ink from the imaging member to a substrate.

20 Claims, 3 Drawing Sheets

SYSTEMS AND METHODS FOR INK-BASED DIGITAL PRINTING USING VARIABLE DATA LITHOGRAPHY INKJET IMAGING SYSTEM

FIELD OF DISCLOSURE

The disclosure relates to ink-based digital printing. In particular, the disclosure relates to printing variable data using an ink-based digital printing system that includes an inkjet subsystem configured for forming base marking material patterns according to the variable data.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system. A "variable data lithography system" is a system that is configured for lithographic printing using lithographic inks and based on digital image data, which may be variable from one image to the next. "Variable data lithography printing," or "digital ink-based printing," or "digital offset printing" is lithographic printing of variable image data for producing images on a substrate that are changeable with each subsequent rendering of an image on the substrate in an image forming process.

For example, a digital offset printing process may include transferring radiation-curable ink onto a portion of a fluorosilicone-containing imaging member surface that has been selectively coated with a dampening fluid layer according to variable image data. The ink is then cured and transferred from the printing plate to a substrate such as paper, plastic, or metal on which an image is being printed. The same portion of the imaging plate may be cleaned and used to make a succeeding image that is different than the preceding image, based on the variable image data. Ink-based digital printing systems are variable data lithography systems configured for digital lithographic printing that may include an imaging member having a reimageable surface layer, such as a silicone-containing surface layer.

Systems may include a dampening fluid metering system for applying dampening fluid to the reimageable surface layer, and an imaging system for laser-patterning the layer of dampening fluid according to image data. The dampening fluid layer is patterned by the imaging system to form a dampening fluid pattern on a surface of the imaging member based on variable data. The imaging member is then inked to form an ink image based on the dampening fluid pattern. The ink image may be partially cured, and is transferred to a printable medium, and the imaged surface of the imaging member from which the ink image is transferred is cleaned for forming a further image that may be different than the initial image, or based on different image data than the image data used to form the first image. Such systems are disclosed in U.S. patent application Ser. No. 13/095,714 ("714 application"), titled "Variable Data Lithography System," filed on Apr. 27, 2011, by Stowe et al., which is commonly assigned, and the disclosure of which is hereby incorporated by reference herein in its entirety.

Systems have also been provided that obviate the expense attached to manufacturing suitable plates for some ink-based digital printing systems. For example, Dalal disclosed a system using solid ink jet to create an imaging plate for ink based digital printing in commonly-assigned U.S. application Ser. No. 13/529,581, titled "Method and Apparatus for Generating a Printing Member," filed Jun. 21, 2012, the disclosure of which is hereby incorporated herein by reference in its entirety. A method of lithographic plate production is disclosed, wherein the image-wise hydrophobic and hydrophilic areas are created on the plate by inkjet. The lithographic plate contains areas of polymer, which results from hardening of the inkjet liquid, and areas of bare plate where the liquid was not applied. The bare plate is hydrophilic, and the polymer is designed to be hydrophobic, similar to the (exposed) photopolymer of the conventional process. In effect, the hydrophobic polymer is applied directly to the image areas using inkjet technology, instead of applying the hydrophobic polymer to the entire plate, imaging through film or laser, and removing the hydrophobic polymer from the non-image areas. Systems for enhanced ink-based digital printing are desired for high-speed, high image-quality printing.

SUMMARY

Variable data lithographic printing system and process designs must overcome substantial technical challenges to enable high quality, high speed printing. For example: (1) digital architecture printing systems for printing with lithographic inks impose stringent requirements on subsystem materials, such as the surface of the imaging plate, ink used for developing an ink image, and dampening fluid or fountain solution; (2) system latitude is tight with respect to dampening fluid thickness because too thin a dampening fluid layer causes background problems while too thick a layer reduces image resolution; (3) it has been found that vapor re-deposition occurs upon laser imaging; (4) image wise exposure by way of a laser imager can be difficult, and may require complex solutions such as, for example, stitching together imagers to enable full width exposure of the imaging plate; and (5) high speed printing variable data lithographic printing is desirable, but limited substantially by a power of the laser imager and fountain solution evaporation. The cost of laser imaging systems for systems such as those disclosed by Stowe also presents a challenge to overcome.

Solutions to the foregoing challenges posed by conventional ink-based digital printing systems and methods have been provided, but have been found to pose further challenges. For example, related art solid inkjet digital printing systems such as those disclosed by Dalal suffer from high costs of plate marking material for solid ink jet approaches. Also, using a large volume of the plate marking material to obviate certain of the above-mentioned challenges can cause image quality problems. Ink transfer is typically around 50% in traditional offset processes; and left over ink and plate marking materials cause substantial waste and present a significant challenge for cleaning subsystems in conventional ink-based digital printing systems.

An ink-based digital printing system including an ink jet imaging system that enables improved performance with no surface energy contrast on the imaging member surface is provided. Methods of ink-based digital printing using an ink-based digital printing system having an ink-jet imaging system are also provided. Systems and methods of embodiments include jetting marking material onto a plate or blanket base. After drying, the jetted plate marking material may become stable or non-fluid on the base and create a true imaging plate with significant surface property contrasts similar to a lithography plate found in conventional lithography printing systems. Subsequently, dampening and inking steps may be used to develop a corresponding ink image from the plate image.

In an embodiment, systems and methods may be configured whereby all ink is transferred, as well as the plate or base marking material, to the substrate on which an ink image is to be printed. Accordingly, ink is efficiently used and a load on cleaning subsystems may be reduced.

In particular, systems and methods of embodiments may include jetting a low viscosity resin onto an imaging member surface according to digital image data to form a patterned fluid layer, or "base marking material" layer. The base marking material layer is dried to form a plate with good contrast between the area of bare plate and the area covered with base marking material. The bare plate may include, for example, a silicone-exposed hydrophobic region or background region, and a hydrophilic region or image region having base marking material disposed thereon. Fountain solution or dampening fluid such as octamethylcyclotetrasiloxane "D4" or cyclopentasiloxane "D5" may be applied to the base marking material layer in a uniform layer, and may spread across the background region, allowing subsequently applied ink to selectively adhere to the image region. A background region includes D4 between the plate and ink. A thickness of the dampening fluid layer is around 0.2 microns, or between 0.05 and 0.5 microns. Systems and methods of embodiments enable increased surface property contrast between the image region and background region of an imaging plate, enhanced printing performance and increased system latitude.

In an embodiment, ink-based digital printing systems may include a central imaging member having an imaging surface; an inkjet system configured to jet base marking material onto the imaging member surface, the inkjet system being configured to jet the base marking material according to digital image data for forming a base marking material image; and an inking system, the inking system being configured to apply ink onto the imaging member surface for forming an ink image overlaying the base marking material image on the imaging member surface, the base marking material image interposing and directly contacting each of the imaging member surface and the ink image.

The base marking material may be a low-viscosity fluid at a jetting temperature that dries to a high tack. Tack refers to a property of an adhesive that enables adherence to another surface upon substantially immediate contact. The material may comprise, for example, a water-based resin, a polymer solution, for example. The material may comprise a latex dispersion, a polymeric resin dispersion, or a starch solution, for example. A "latex dispersion" for use in methods and systems of embodiments refers to a material having polymer microparticles or polymer emulsions distributed in an aqueous medium. In particular, latexes are colloidal suspensions of polymer particles stabilized by dispersing agents in an aqueous medium, and may comprise natural or synthetic polymeric compounds, such as polyisoprene. A "polymeric resin" for use in methods and systems of embodiments is any plastic resin material having suitable viscosity at a temperature of application to the imaging member surface, and that is configured to harden upon drying, for example, and/or dries to a high tack. A polymer resin may be a clear liquid plastic product that hardens to create a durable, glossy coating. A "starch" solution for use in methods and systems of embodiments refers to a suitable carbohydrate-containing solution. A combination/mixture of the above materials can also be used. For example, an emulsion comprising a water-based fluid containing dissolved carbohydrates and protein aggregates may be used, such as milk, which has been found to be suitable for methods and systems of embodiments.

Systems may include dampening fluid metering system, the metering system being configured to apply a dampening fluid to the imaging member after the inkjet system jets base marking material onto the imaging member surface during a printing process as the imaging member translates in a process direction. The dampening fluid may be applied by vapor condensation, for example. Systems may include a dampening fluid metering system, the metering system being configured to apply a water-based fountain solution to the imaging member after the inkjet system jets base marking material onto the imaging member surface during a printing process as the imaging member translates in a process direction. Systems may include a dampening fluid metering system, the metering system being configured to apply D4 to the imaging member after the inkjet system jets base marking material onto the imaging member surface during a printing process as the imaging member translates in a process direction.

In an embodiment, methods for high speed ink-based digital printing may include jetting base marking material onto a surface of an imaging member to form a latent image according to digital image data; applying dampening fluid to the imaging member; and applying ink to the imaging member, whereby the ink adheres to the imaging member surface having base marking material disposed thereon to form an ink image that corresponds to the latent image. Methods may include contacting the ink image at an image transfer nip, the image transfer nip being formed by the imaging member and a backing roll, whereby the contacting causes the ink image to adhere to a substrate at the nip, and detach from the imaging member surface. Methods may include using an inkjet configured for jetting base marking material. Alternatively, methods may include metering ink onto the imaging member using an anilox roll ink delivery system. Methods may include applying dampening fluid further comprising applying the layer of dampening fluid using a vapor condensation dampening fluid metering system. The base marking material may comprise a water-based polymer solution/dispersion.

Methods may include partially curing the ink, before the contacting, for increasing cohesion of the ink. Methods may include contacting the ink image at an image transfer nip, the image transfer nip being formed by the imaging member and a backing roll, whereby the contacting causes the ink image to adhere to a substrate at the nip, and separate from the imaging member surface, whereby the base marking material is separated from the imaging member surface, the ink image interposing the base marking material and the substrate.

In an embodiment, systems for ink-based digital printing may include an imaging member; an inkjet system for applying a base marking material to the imaging member to form a pattern according to digital image data; a dampening fluid metering system configured for applying dampening fluid to the imaging member after the applying base marking material; and an inking system configured for applying ink to the imaging member, the ink adhering to the base marking material pattern.

Exemplary embodiments are described herein. It is envisioned, however, that any system that incorporates features of systems described herein are encompassed by the scope and spirit of the exemplary embodiments.

DETAILED DESCRIPTION

Figure 1:
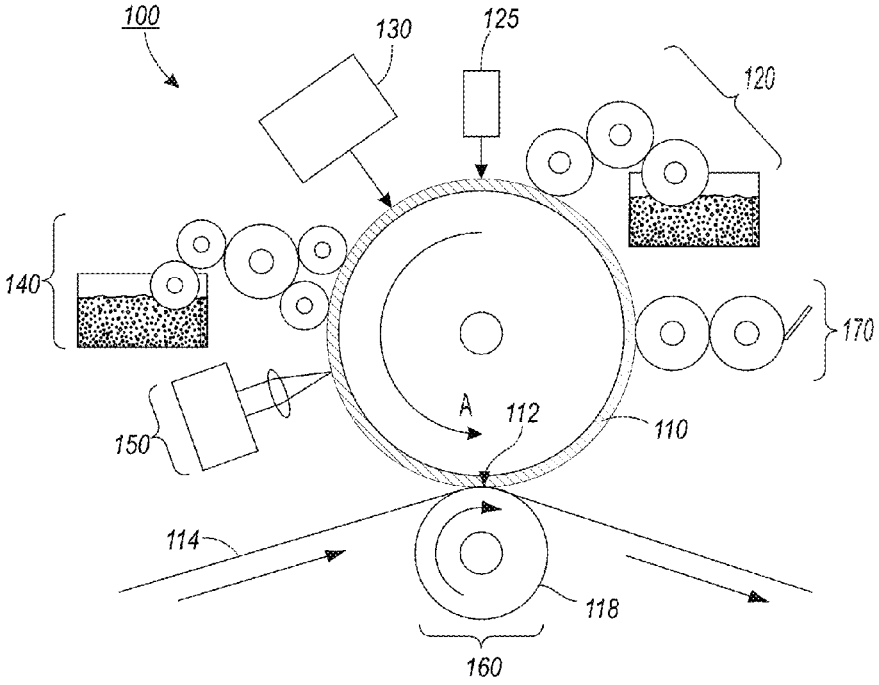
FIG. 1 RELATED ART
FIG. 1 shows a side diagrammatical view of a related art ink-based digital printing system.

Exemplary embodiments are intended to cover all alternatives, modifications, and equivalents as may be included within the spirit and scope of the apparatus and systems as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of systems for ink-based digital printing using an inkjet imaging system in accordance with embodiments. In the drawings, like reference numerals are used throughout to designate similar or identical elements. The drawings depict various embodiments of illustrative systems for ink-based digital printing using an inkjet imaging system, and illustrate transfer efficiency of water dilutable and water diluted inks suitable for ink-based digital printing.

Offset printing processes produce prints having very high image quality, have high reliability or robustness, and low cost of manufacture and operation. These advantageous features can be attributed to the large surface property contrast between two areas of a surface of the imaging number, and image area and a background area disposed on the imaging member surface. Many challenges in conventional ink-based digital printing systems have been found to be traceable to the fact that such systems include an imaging member, a plate or blanket, having only one type of surface. This makes it difficult to find a compatible set of plate, ink, and dampening fluid materials, and makes it difficult to achieve acceptable background, an image having fine details, and uniformity simultaneously.

Further, conventional ink-based printing systems are limited in print process speed due mostly to the power required to evaporate the dampening fluid or fountain solution applied to the surface of the imaging member. Also, because each laser imager unit is only about 2 cm. wide, imager stitching, which is technically challenging, has been provided wherein two or more imagers are combined to increase a width of an exposure area of the imager unit.

It has also been found that during laser exposure, evaporated fountain solution may need to be removed immediately. Otherwise, vaporized fountain solution may re-deposit onto the plate causing image quality problems such as voids in the applied ink layer. Airflow around an imaging plate may be carefully delivered to achieve good image quality and avoid vapor re-deposition, which is technically challenging. It has further been found that a dampening fluid or fountain solution layer may be unstable, particularly at sharp corners as the surface tension tends to move out corners, causing pull-back.

The 714 application describes an exemplary related art variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a drum, plate or a belt, or another now known or later developed configuration. The reimageable surface may be formed of materials including, for example, a class of materials commonly referred to as silicones, including polydimethylsiloxane (PDMS), among others. The reimageable surface may be formed of a relatively thin layer over a mounting layer, a thickness of the relatively thin layer being selected to balance printing or marking performance, durability and manufacturability.

The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 application also explains the wide latitude of marking (printing) materials that may be used, including marking materials with pigment densities greater than 10% by weight. As does the 714 application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 application depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a dampening fluid system 120 generally comprising a series of rollers, which may be considered as dampening rollers or a dampening unit, for uniformly wetting the reimageable surface of the imaging member 110 with dampening fluid. A purpose of the dampening fluid system 120 is to deliver a layer of dampening fluid, generally having a uniform and controlled thickness, to the reimageable surface of the imaging member 110. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Exemplary dampening fluids include water, NOVEC 7600 (1,1,1,2,3,3-Hexafluoro-4-(1,1,2,3,3,3-hexafluoropropoxy)pentane and has CAS#870778-34-0.), and D4 (octamethylcyclotetrasiloxane). Other suitable dampening fluids are disclosed, by way of example, in co-pending U.S. patent application Ser. No. 13/284,114, titled "Dampening Fluid For Digital Lithographic Printing," filed on Oct. 28, 2011, by Stowe, the disclosure of which is hereby incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid system 120.

After a precise and uniform amount of dampening fluid is provided by the dampening fluid system 120 on the reimageable surface of the imaging member 110, and optical patterning subsystem 130 may be used to selectively form a latent image in the uniform dampening fluid layer by image-wise patterning the dampening fluid layer using, for example, laser energy. Typically, the dampening fluid will not absorb the optical energy (IR or visible) efficiently. The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 application. Briefly, the application of optical patterning energy from the optical patterning subsystem 130 results in selective removal of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 170. The 714 application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid system 120 by which a fresh layer of dampening fluid is supplied to the reimageable surface of the imaging member 110, and the process is repeated.

Figure 2:
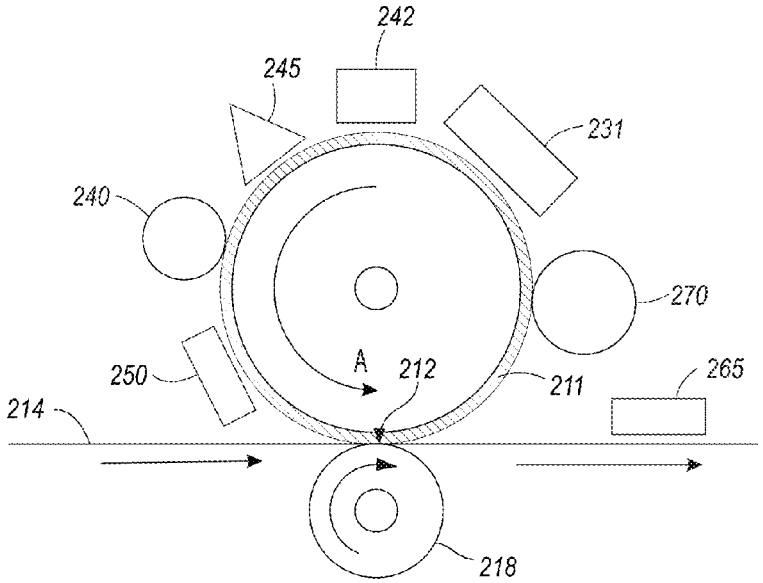
FIG. 2 shows a diagrammatical side view of an ink-based digital printing system with inkjet imaging subsystem in accordance with an embodiment.

An ink-based digital printing system including an ink-jet imaging system in accordance with an embodiment is shown in FIG. 2. In particular, FIG. 2 shows an imaging member surface 211 that forms an ink transfer nip 212. A paper transport 214 is configured to pass through the ink transfer nip 212. The ink transfer nip 212 is formed by the imaging member surface 211 and a backing roll 218. The imaging member on which the imaging member surface 211 is disposed is configured to translate in a direction A. The backing roll 218 is configured to translate in an opposing direction, allowing the paper transport 214 to pass through the nip 212 in a process direction.

FIG. 2 shows an ink-jet imaging system 231. In embodiments, an ink-jet imaging system is configured to apply a base marking material onto the imaging member surface 211 by jetting the material onto the surface according to digital image data. Imaging member surface 211 may be a base plate. A base marking material for use with systems and methods of embodiments may comprise, for example, a water-based polymeric marking material. Alternatively, the base marking material may comprise a material that dries to a high tack, or that is sticky upon drying. Another alternative marking material may include a marking material that dries to a solid state, and has a low viscosity at a jetting temperature. Exemplary base marking materials may include, for example, starch solution, polymeric solution, latex dispersion, polymeric resin dispersion etc. The marking material may be jetted form the ink jet system 231 onto the imaging member surface 211 to form a marking material layer according to digital image data.

The jetted marking material may be dried on the imaging member surface 211 after jetting. In particular, FIG. 2 shows a drying system 242. The drying system may be formed of heating and airflow means now known or later developed, or a combination of these two means. The drying system may be configured to remove water or solvent from the jetted marking material, and let the plate marking material firmly anchor onto the imaging member surface 211 to form a true image plate with substantial surface property contrast: surface energy contrast, hydrophobicity contrast, and surface texture contrast.

FIG. 2 shows a dampening vapor system 245. Dampening fluid or fountain solution may be applied using a traditional dampening fluid metering system, or other dampening fluid application system now known or later developed, such as a dampening fluid vapor system that meters fluid onto the imaging member using vapor condensation. Applying dampening fluid by condensation in digital architecture lithographic printing systems and systems for doing the same are disclosed in U.S. patent application Ser. No. 13/426,262, titled "Dampening Fluid Deposition By Condensation In A Digital Lithographic System," filed on Mar. 21, 2012, by Liu et al., the disclosure of which is hereby incorporated by reference herein in its entirety. The dampening fluid may be applied to the surface 211 of the imaging member in a uniform layer of less than 0.5 micron or preferably about 0.1 micron, for example.

FIG. 2 shows an inking system 240. An inking system may be formed of any inking system now known or later developed that is suitable for applying ink to the imaging member surface 211. In an embodiment, ghost-free inking may be desired, and as such a ghost-free inking system may be preferred, such as an anilox roll inking system.

In an embodiment, a positive image may be developed on the imaging member surface 211 by applying the ink thereon, which selectively adheres to regions of the surface 211 on which the base marking material is present. The plate base marking material should have sufficient tacking ability, and the adhesion of the base marking material to the imaging member surface 211 should be sufficiently strong such that a uniform ink layer is formed on the surface 211 by the inker 240 with little or no lift-off of plate marking material.

FIG. 2 shows a pre-cure system 250. The pre-cure or rheological conditioning system enables an optional step for improving ink image cohesion in preparation for ink transfer at the ink transfer nip 212. For example, the pre-cure system may include a radiation source such as a UV lamp for exposing the ink to an amount of UV light suitable for at least partially curing the ink, thereby increasing ink cohesion. After conditioning, both an ink image and base marking material will transfer to a substrate that is disposed on or constitutes a paper transport 214. The base marking material overlays the resulting transferred printed ink image, and serves as an overcoat. The plate is left substantially free of ink or base marking material.

FIG. 2 shows a cleaning system 270. Cleaning system 270 enables a cleaning step for removing residual ink and residual base marking material, and resetting plate base material for a next cycle for printing of an image in accordance with image data that may vary from the previous image printing.

Figure 3:
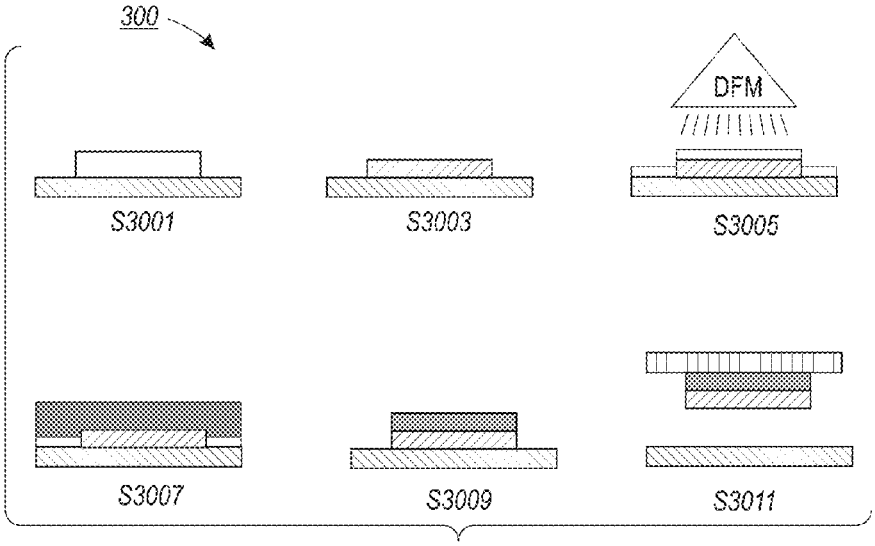
FIG. 3 shows a diagrammatical cross-sectional view and flow diagram of ink-based digital imaging and printing processes in accordance with exemplary embodiments.

FIG. 3 shows methods of ink-based digital printing using an ink-jet imaging system in accordance with an embodiment. In particular, FIG. 3 shows a method for ink-based printing 300. The method 300 includes jetting at S3001 a base marking material onto a base plate or surface of an imaging member. Preferably, a water-based polymeric marking material may be used as a base marking material. Alternatively, other materials that have a high tack, or form a solid state upon drying may be used. The method 300 includes drying of the plate marking material image at S3003. In particular, the image formed at S3001 may be dried to remove the water/solvent from the jetted material to thereby let the plate marking material firmly anchor onto the plate base and form a true image with significant surface property contrast between image and background regions of the plate base, and satisfy conditions that under which lift off of dampening fluid does not occur.

The method 300 shown in FIG. 3 includes applying a fountain solution or dampening fluid layer at S3005 onto the plate base, over the dried marking material image formed at S3003. FIG. 3 shows that method 300 includes inking at an inking nip at S3007 to form, for example, a positive image wherein the ink adheres to image regions and does not adhere to non-image regions. In a background area, the dampening fluid will naturally separate the ink from the bare plate, which requires stringent chemical and physical properties, including suitable miscibility and surface energy, for example, among three interacting materials: ink, dampening fluid, and the imaging member surface or plate. In the image area, the dampening fluid will fail to naturally separate. This is so for several reasons, including: 1) the base marking material can absorb the dampening fluid; 2) the base marking material can have a rough texture; and 3) the dampening fluid fails to separate the ink from the base marking material in a clean layer form. The dampening fluid will break up into small droplets at the interface between the ink and the base marking material, allowing significant contact between the ink and the base marking material.

A plate marking material should have sufficient tack, and the adhesion of the plate marking material to the plate base should be sufficiently strong such that the ink layer splits at the exit of the inking nip as shown at S3009. In an embodiment, systems are configured so that substantially no splitting or lift-off of plate base marking materials from the plate occurs at the inking nip.

FIG. 3 shows transferring the marking material and ink image to a final substrate at S3011. In this step, the system is configured such that the ink image and the base marking material peel off from the bare plate cleanly. It is generally required that the cohesions of the ink and the base marking material and the adhesion between the ink and the base marking material are substantially stronger that the adhesion between the bare plate and the base marking material. For optimal performance, an optional rheological conditioning step can be executed before the transfer step S3011.

EXAMPLE

A number of exemplary base marking materials, including starch solution, latex dispersion, polymer solution, etc., have been applied to an ink-based digital printing system imaging member surface. The imaging member surface as formed of fluorosilicone. D4 has been used as the dampening fluid. Images were formed using the exemplary base marking materials that demonstrated good quality. It was found that systems and methods in accordance with embodiments enable a system that offers greater latitude for the ink-based digital printing process, broader design space for inks, plate materials, and dampening fluids, true high-speed printing, limited need for vapor removal designs, reduced pull-back challenges, low imager risks, and same or similar low running costs as compared to conventional ink-based printing systems.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A water dilutable ink-based digital printing system, comprising:

a central imaging member having an imaging surface;

an inkjet system configured to jet base marking material configured to attract water-based ink onto the imaging member surface, the inkjet system being configured to jet the base marking material according to digital image data for forming a base marking material image; and an inking system, the inking system being configured to apply water-based ink onto the imaging member surface for forming an ink image overlaying the base marking material image on the imaging member surface, the base marking material image interposing and directly contacting each of the imaging member surface and the ink image.

2. The system of claim 1, wherein the base marking material is a low-viscosity fluid at a jetting temperature, and wherein the marking material dries to a high tack.

3. The system of claim 1, wherein the base marking material is a water-based resin.

4. The system of claim 1, wherein the base marking material comprises polymer solution.

5. The system of claim 1, wherein the base marking material comprises latex dispersion.

6. The system of claim 1, wherein the base marking material comprises polymeric resin dispersion.

7. The system of claim 1, wherein the base marking material comprises a starch solution.

8. The system of claim 1, comprising:

a dampening fluid metering system, the metering system being configured to apply a dampening fluid to the imaging member after the inkjet system jets base marking material onto the imaging member surface during a printing process as the imaging member translates in a process direction.

9. The system of claim 8, wherein the dampening fluid metering system is configured to apply dampening fluid by vapor condensation.

10. The system of claim 1, comprising:

a dampening fluid metering system, the metering system being configured to apply a water-based fountain solution to the imaging member after the inkjet system jets base marking material onto the imaging member surface during a printing process as the imaging member translates in a process direction.

11. The system of claim 1, comprising:

a dampening fluid metering system, the metering system being configured to apply octamethylcyclotetrasiloxane to the imaging member after the inkjet system jets base marking material onto the imaging member surface during a printing process as the imaging member translates in a process direction.

12. A method for high speed water dilutable ink-based digital printing, comprising:

jetting base marking material configured to attract water-based ink onto a surface of an imaging member to form a latent image according to digital image data;

applying dampening fluid to the imaging member; and applying water-based ink to the imaging member, whereby the water-based ink adheres to the imaging member surface having base marking material disposed thereon to form an ink image that corresponds to the latent image.

13. The method of claim 12, comprising:

contacting the ink image at an image transfer nip, the image transfer nip being formed by the imaging member and a backing roll, whereby the contacting causes the ink image to adhere to a substrate at the nip, and detach from the imaging member surface.

14. The method of claim 13, comprising:

partially curing the ink, before the contacting, for increasing a cohesion of the ink.

15. The method of claim 14, comprising:

contacting the ink image at an image transfer nip, the image transfer nip being formed by the imaging member and a backing roll, whereby the contacting causes the ink image to adhere to a substrate at the nip, and separate from the imaging member surface, whereby the base marking material is separated from the imaging member surface, the ink image interposing the base marking material and the substrate.

16. The method of claim 12, the jetting further comprising using an inkjet configured for jetting base marking material.

17. The method of claim 12, the applying further comprising metering ink onto the imaging member using an anilox roll ink delivery system.

18. The method of claim 12, the applying dampening fluid further comprising applying the layer of dampening fluid using a vapor condensation dampening fluid metering system.

19. The method of claim 12, wherein the base marking material comprises a water-based polymer solution/dispersion.

20. A system for water dilutable ink-based digital printing, comprising:

an imaging member having a reimageable surface;

an inkjet system for applying a base marking material configured to attract water-based ink to the reimageable surface of the imaging member to form a pattern according to digital image data;

a dampening fluid metering system configured for applying dampening fluid to the reimageable surface of the imaging member after the applying base marking material; and an inking system configured for applying water-based ink to the reimageable surface of the imaging member, the water-based ink adhering to the base marking material pattern.

* * * * *